US008993070B2

(12) United States Patent
Jaworowski et al.

(10) Patent No.: US 8,993,070 B2
(45) Date of Patent: Mar. 31, 2015

(54) DUAL POWDER COATING METHOD FOR ALUMINUM SUBSTRATES

(75) Inventors: Mark R. Jaworowski, Glastonbury, CT (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 283 days.

(21) Appl. No.: 13/498,175

(22) PCT Filed: Sep. 16, 2010

(86) PCT No.: PCT/US2010/049034
§ 371 (c)(1),
(2), (4) Date: Mar. 26, 2012

(87) PCT Pub. No.: WO2011/037807
PCT Pub. Date: Mar. 31, 2011

(65) Prior Publication Data

US 2012/0183755 A1 Jul. 19, 2012

Related U.S. Application Data

(60) Provisional application No. 61/246,281, filed on Sep. 28, 2009.

(51) Int. Cl.
*B05D 1/06* (2006.01)
*B05D 1/12* (2006.01)
(Continued)

(52) U.S. Cl.
CPC ..... *B05D 7/546* (2013.01); *B05D 3/0254* (2013.01); *F28F 19/04* (2013.01); *F28F 21/084* (2013.01);
(Continued)

(58) Field of Classification Search
USPC ..... 427/470, 202, 205
See application file for complete search history.

(56) References Cited

U.S. PATENT DOCUMENTS 5,453,295 A 9/1995 Sammel et al.
5,958,204 A 9/1999 Creech et al.
(Continued)

FOREIGN PATENT DOCUMENTS

CN 1739866 A 3/2006
EP 2060328 A2 5/2009
GB 2328628 A 3/1999

OTHER PUBLICATIONS

Selected Abstracts of Thermal Spray Literature Dec. 1990-Dec. 1991, Journal of Thermal Spray Technology; Vo;. 1, No. 1; Mar. 1992; pp. 89-91.
(Continued)

*Primary Examiner* — Frederick Parker
(74) *Attorney, Agent, or Firm* — Cantor Colburn LLP

(57) ABSTRACT

A method includes applying a first powder to an aluminum article and heating the first powder to form a first layer on the aluminum article providing mechanical strength, corrosion durability and bonding potential. The method also includes applying a second powder to the aluminum article and heating the second powder to form a second layer on the aluminum article protecting the aluminum article from ultraviolet radiation. A coated article includes an aluminum substrate, an epoxy layer and a topcoat layer. The epoxy layer promotes adhesion, enhances corrosion durability and provides mechanical strength, and is formed by applying a first powder containing an epoxy to the aluminum substrate and curing the first powder. The topcoat layer provides resistance to ultraviolet radiation and environmental contaminants, and is formed by applying a second powder to the aluminum substrate and curing the second powder.

13 Claims, 4 Drawing Sheets

(51) Int. Cl.

| | |
|---|---|
| ***B05D 1/36*** | (2006.01) |
| ***B05D 7/00*** | (2006.01) |
| ***B05D 3/02*** | (2006.01) |
| ***F28F 19/04*** | (2006.01) |
| ***F28F 21/08*** | (2006.01) |
| *B05D 3/10* | (2006.01) |

(52) U.S. Cl.

CPC ..... *B05D 3/102* (2013.01); *B05D 7/542* (2013.01); *B05D 2202/25* (2013.01); *B05D 2451/00* (2013.01)

USPC ..... 427/470; 427/202; 427/205

(56) References Cited

U.S. PATENT DOCUMENTS

| | | | | |
|---|---|---|---|---|
| 6,706,415 | B2 | 3/2004 | Cooper et al. | |
| 6,866,941 | B2 | 3/2005 | Cooper et al. | |
| 2002/0090823 | A1 | 7/2002 | Grubb et al. | |
| 2002/0122886 | A1 | 9/2002 | Dolan et al. | |
| 2003/0166787 | A1 * | 9/2003 | Rechenberg et al. | 525/326.2 |
| 2006/0173113 | A1 * | 8/2006 | Yabuta et al. | 524/439 |
| 2009/0130304 | A1 | 5/2009 | Muth et al. | |
| 2009/0232968 | A1 * | 9/2009 | Gross et al. | 427/11 |

OTHER PUBLICATIONS

"Selected Abstracts of Thermal Spray Literature", Journal of Thermal Spray Technology; vol. 4, No. 3; Sep. 1995; pp. 297-303.

"Selected Abstracts of Thermal Spray Literature", Journal of Themal Spray Technology; vol. 6, No. 3; Sep. 1997; pp. 373-378.

Brundle, C.A., In the News, publications and Education, Journal of Thermal Spray Technology; vol. 2, No. 2; Jun. 1993; pp. 112-119.

C. Moreau, Flattening and Solidification of Thermally Sprayed Particles, Journal of Thermal Spray Technology; vol. 1, No. 4; Dec. 1992; pp. 317-323.

Sampson, E.R., et al. "Arc Spray Process for the Aircraft and Stationary Gas Turbine Industry". Journal of Thermal Spray Technology; vol. 6, No. 2, Jun. 1997; pp. 150-152.

Sampson, The Last Word-The "Job Shop" Forum, Journal of Thermal Spray Technology; vol. 7, No. 4; Dec. 1998; pp. 477-478.

Sampson, Elliott R., et al. "Arc Spray Corrosion Applications". National Association of Corrosion Engineers 1998; No. 518; pp. 518/1-518/5.

J. Svantesson, et al. "A Study of Ni-5wt.% Al Coatings Produced from Different Feedstock Powder". Journal of Thermal Spray Technology; vol. 1, No. 1, Mar. 1992; pp. 65-70.

K. P. Fischer, Performance History of Thermal-Sprayed Aluminum Coatings in Offshore Service, Journal of Material Performance, vol. 34, No. 4; pp. 27-35.

K. Tani, et al. "Status of Thermal Spray Technology in Japan". Journal of Thermal Spray Technology; vol. 1, No. 4; Dec. 1992; pp. 333-339.

Knuuttila, "Sealing of Thermal Spray Coatings by Impregnation". Journal of Thermal Spray Technology; vol. 8, No. 2; Jun. 1999; pp. 249-257.

Doble, et al. "Use of Thermally Sprayed Aluminum in the Norwegian Offshore Industry" Protective Coatings, Europe; vol. 2, No. 4; Apr. 1997, pp. 1-10.

Parks, "Aluminum Sprayed Coatings on Board U.S. Navy Ships a Ten Year Overview". Proceedings of the National Thermal Spray Conference, 1987. pp. 389-392.

Pawlowski "The Science and Engineering of Thermal Spray". The Science and Engineering of Thermal Spray, Book Published by Chichester, New York: Wiley, C1995. pp. 334-335.

Procedure Handbook for Shipboard Thermal Sprayed Coating Applications, United States Navy David Taylor research Center, National Steel and Shipbuilding Company Sand Diego, CA, Procedure Handbook, (Mar. 1992) pp. 1-216.

Thermal Spray Coatings, Encyclopedia of Electrical and Electronics Engineering, 1998, pp. 40-49.

Thermal Spraying: New Construction and Maintenance, Department of Army, US Army Crops of Engineers, Engineering Manual, Jan. 29, 1999. pp. 1-87.

Xu, et al. "Application of electric Arc Spraying technique to Enhance Corrosion Resistance of Steel Structures on Ships". (China Mechanical engineering Society), Curf. Eng., vol. 11 (No. 1), 1995. p. 38, 40.

Selected abstract of Thermal Spray Literature, Journal of thermal Spray Technology, vol. 5(1) Mar. 1996. pp. 84.

Extended Search Report for related EP App. No. 10819268.3-1353; dated Apr. 9, 2014; 7 pgs.

* cited by examiner

DUAL POWDER COATING METHOD FOR ALUMINUM SUBSTRATES

BACKGROUND

In certain environments, aluminum articles are subjected to contaminants that cause corrosion or other undesired effects on the aluminum surface. Unprotected aluminum can become corroded by acids, salts and other reactive compounds to develop pits or holes on and through aluminum surfaces. Ultraviolet (UV) radiation can cause discoloring of aluminum surfaces. Aluminum articles, such as heat exchangers, are often coated to protect aluminum and aluminum alloy surfaces. Such coatings provide resistance to corrosion caused by environmental contaminants or ultraviolet (UV) radiation or increase mechanical strength. These coatings can be applied to aluminum surfaces in a number of ways. Coating methods include electroplating, dip coating, spray coating and electrostatic powder coating. Protective coatings include conversion coatings and paint coatings.

Powder coating provides a less expensive way to coat aluminum articles. Powder coatings do not require special baths or large quantities of chemicals other than the powder coatings themselves. Powder coatings do not require solvents which can adversely impact air and water quality or can permanently damage aluminum articles. Traditional powder coatings have drawbacks, however. Prior to the present invention, powder coating formulations were generally optimized for one function (i.e. strength/bonding or UV resistance), but not both. Additionally, the traditional application of powder coatings did not provide the amount of control and uniformity that other coating processes possessed. Uniform levels of powder coatings are difficult to apply. In some cases, bare metal was left exposed following powder coating. This bare metal did not possess any of the protective characteristics that the powder coating provided. On the other hand, in some locations, the powder coating was excessively thick, which was detrimental for surface characteristics such as thermal and hydraulic properties.

SUMMARY

A method according to the present invention includes applying a first powder to an aluminum article and heating the first powder to form a first layer on the aluminum article providing mechanical strength, corrosion durability and bonding potential. The method also includes applying a second powder to the aluminum article and heating the second powder to form a second layer on the aluminum article protecting the aluminum article from ultraviolet radiation.

The present invention also provides a coated article having an aluminum substrate, an epoxy layer and a topcoat layer. The epoxy layer promotes adhesion, enhances corrosion durability and provides mechanical strength, and is formed by applying a first powder containing an epoxy to the aluminum substrate and curing the first powder. The topcoat layer provides resistance to ultraviolet radiation and environmental contaminants, and is formed by applying a second powder to the aluminum substrate and curing the second powder.

DETAILED DESCRIPTION

Figure 1:
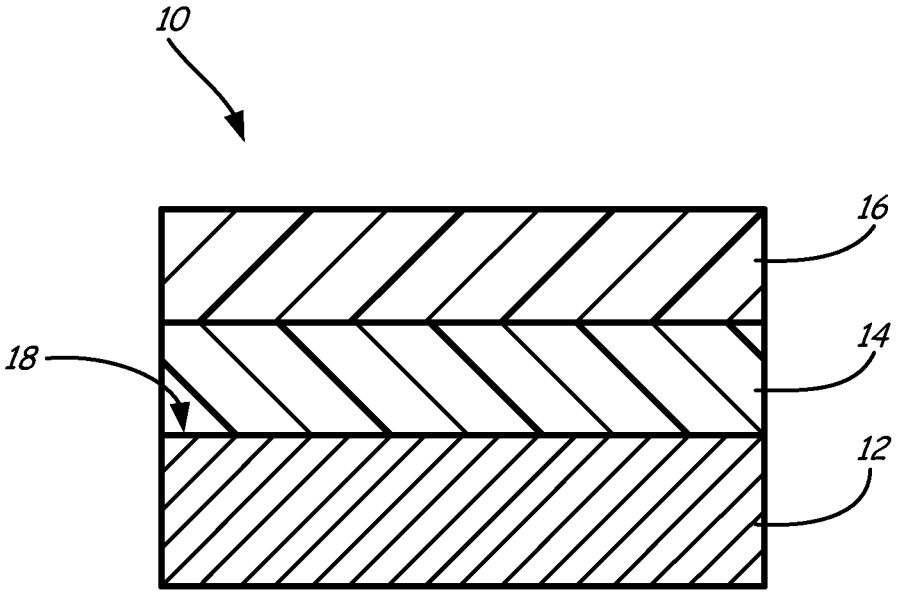
FIG. 1 is a side sectional view of a powder coating system for use on an aluminum article.

The present invention describes a dual powder coating system which can provide improved bonding capabilities and improved environmental protection for aluminum articles such as heat exchangers. The dual powder coating system allows for the application of two powder-based coatings to an aluminum article: one to primarily enhance the mechanical strength, corrosion durability and/or adhesive bonding characteristics of the aluminum article and another one to primarily provide additional resistance to UV radiation. The dual powder coating system can work with any type of aluminum article and is particularly useful for aluminum heat exchangers, especially aluminum microchannel heat exchangers. While specific embodiments are described with reference to aluminum heat exchangers, the invention can also provide benefits to other aluminum articles. "Aluminum articles" refers to articles containing aluminum, aluminum alloys or a combination of the two.

Heat exchangers are used in a variety of environments, including marine, industrial and urban environments. Often, heat exchanger surfaces are aluminum and subject to the corrosion and discoloring described above. Heat exchangers can contain inlet and outlet manifolds; heat exchange tubes, coils or channels; fins and other structures that are made of aluminum or aluminum alloys. All of these surfaces need to be protected in order to prevent or reduce corrosion and other undesired effects.

Multiple coatings can be applied to the surfaces of a heat exchanger. Various coatings can be applied to an aluminum heat exchanger by spraying, dipping, painting or brushing, anodization, electroplating and other methods. In order for multiple coatings to effectively adhere to the surface of a heat exchanger, the surface chemistry of the heat exchanger must sometimes be changed. The surface chemistry is modified to provide improved bonding potential between the surface of the heat exchanger and subsequent coating layers. An adhesion promoting coating can be used to modify the heat exchanger surface so that later applied coatings bond to the surface strongly. Epoxy-based coatings are one type of coating that improves bonding and adhesion between an aluminum surface and later applied coatings. Epoxy-based coatings also provide additional mechanical strength and improved corrosion durability of the aluminum surface.

Epoxy-based coatings can deteriorate when exposed to UV radiation. As such, a second coating can be applied to surfaces of a heat exchanger to provide UV protection. Acrylics, polyester-based thermoplastic polyurethanes and polyester triglycidyl isocyanurate (TGIC) are types of coatings that provide resistance to UV radiation. The second coating also adds a mechanical barrier to protect any areas of the heat exchanger that were missed when the first coating was applied.

Some heat exchangers (i.e. aluminum microchannel heat exchangers) often have complex geometries with sharp corners and edges and small spaces that make coating the heat exchanger surfaces difficult. Powder coatings typically do not provide as much control and self-leveling as some of the other coating technologies might (e.g., electrophoretic painting). Nonetheless, powder coatings make up for some of these deficiencies with other advantages (no toxic solvents, easier to apply, no need for rinsing and drying operations, etc.). A single application of a powder coating can leave areas of the heat exchanger uncoated where bare aluminum is exposed. Applying a second powder coating over a first powder coating minimizes the impact of uncoated and exposed aluminum. The second coating is able to infiltrate gaps left by the first coating so that the aluminum receives some level of additional protection. While the second coating primarily provides protection from UV radiation, the second coating also provides at least some increase in mechanical strength and corrosion protection.

FIG. 1 illustrates a side sectional view of dual powder coating system 10 and aluminum article 12. Dual powder coating system 10 includes first layer 14 and second layer 16. First layer 14 is formed on surface 18 of aluminum article 12 using a first powder. First layer 14 improves the mechanical strength, corrosion durability and bonding capabilities of surface 18. Second layer 16 is formed over first layer 14 on surface 18 using a second powder. Second layer 16 improves the UV resistance of surface 18.

The first powder and the second powder are applied to surface 18 in different steps. The first powder can be applied following cleaning of surface 18. Where surface 18 was previously contacted with brazing flux material and brazed, any residual flux may need to be removed so that first layer 14 can bond strongly with surface 18. A method for removing residual flux is provided in International Application No. PCT/US09/42552, filed May 1, 2009, which is incorporated by reference.

First layer 14 is formed by applying the first powder to surface 18. The first powder is selected to provide additional mechanical strength and improve corrosion durability of surface 18 and/or promote adhesion and bonding between surface 18 and later applied coatings. Suitable first powders include epoxy-based powder coatings such as epoxies, polyester epoxies, acrylic epoxies, fusion-bond epoxy powder coatings and combinations thereof. Specific examples of suitable first powders include epoxy powder coatings based on Bisphenol A or Bisphenol F resins.

First layer 14 is formed by applying the first powder to surface 18 and heating the first powder. The first powder can be applied to surface 18 by spraying, dipping, fluidized bed spraying, electrostatic deposition, electrostatic magnetic brush coating and combinations thereof. The first powder can be applied to surface 18 and then heated, applied to an already heated surface 18 or a combination of the two. Heat can be applied to surface 18 and/or the first powder by induction heating, oven heating, infra-red heating and combinations thereof.

One method of applying the first powder to surface 18 and forming first layer 14 includes spraying the first powder onto surface 18 and then heating the first powder. A wide variety of spray guns or nozzles can be used, depending on the consistency of the first powder. The first powder is sprayed evenly across surface 18. The first powder is then heated (cured) either directly or by heating surface 18. Once the first powder melts, it forms a uniform film on surface 18. The first powder and surface 18 are cooled to form first layer 14.

Application methods can also be combined to increase their effectiveness. For example, during fluidized bed spraying, the first powder is fluidized, suspended in a stream of air (or other gas). Often, the fluidized first powder is sprayed onto heated surface 18 using suitable spray guns or nozzles. Once the fluidized first powder contacts heated surface 18, first powder melts into a liquid. The liquid is cooled, forming first layer 14. Fluidized bed spraying can be combined with electrostatic deposition. The fluidized first powder is applied using an electrostatic spray gun. The electrostatic spray gun ionizes the first powder, imparting its particles with a positive electric charge. Heated surface 18 is grounded or imparted with a negative charge. The positively charged fluidized first powder uniformly deposits on heated surface 18 due to the powder's positive electrical charge and melts into a liquid form. The liquid is cooled, forming first layer 14. In one exemplary embodiment, the first powder is electrostatically sprayed onto surface 18 and then heated to provide a uniform first layer 14.

Second layer 16 is formed by applying the second powder to surface 18. The second powder is selected to provide additional UV resistance to first layer 14 and surface 18. Epoxies can deteriorate following exposure to UV radiation. Where first layer 14 is epoxy-based, first layer 14 can deteriorate unless it is protected from UV radiation. Suitable second powders include thermoset powder coatings such as acrylics, polyester-based thermoplastic polyurethanes, polyester triglycidyl isocyanurate (TGIC) and combinations thereof. Specific examples of suitable second powders include acrylic clearcoats such as PCC10106 (available from PPG industries).

Second layer 16 is formed in similar fashion to first layer 14. Second layer 16 is formed by applying the second powder to surface 18 (already covered with first layer 14) and heating the second powder. The second powder can be applied to surface 18 by spraying, dipping, fluidized bed spraying, electrostatic deposition, electrostatic magnetic brush coating and combinations thereof. The second powder can be applied and then heated, applied to an already heated surface 18 or a combination of the two. Heat can be applied to surface 18 and/or the second powder by induction heating, oven heating, infra-red heating and combinations thereof. The methods and examples described above with respect to the first powder can also be used for the second powder.

First layer 14 and second layer 16 can have varying thicknesses depending on various needs such as the heat exchanger's operating environment. Typically, first layer 14 and second layer 16 each have a thickness between about 15 microns and about 35 microns. This range of thickness is appropriate for most heat exchange applications. In an exemplary embodiment, first layer 14 and second layer 16 each have a thickness of about 25 microns.

The time and temperature required for curing the first and second powders depends on the design of surface 18 (e.g., convoluted surfaces, flat surface, etc.), the chemistry of surface 18 (e.g., aluminum, aluminum alloy, etc.), the characteristics of the first and second powders selected, the thicknesses of first layer 14 and second layer 16 and the curing oven characteristics. For most surfaces 18 and first and second powders described herein, a curing temperature between about 190° C. (375° F.) and about 200° C. (390° F.) is typical. At these temperatures, curing times between about 10 minutes and about 15 minutes are appropriate.

First layer 14 and second layer 16 can also contain additional corrosion-inhibiting compounds. These compounds can be incorporated into the first powder and/or the second powder so that they are incorporated into first layer 14, second layer 16 or both layers 14 and 16. Suitable additional corrosion-inhibiting compounds include corrosion inhibitive pigments, galvanically sacrificial metals (e.g., zinc, zinc alloys, magnesium), lanthanoids, molybdates, vanadates and tungstates.

In one exemplary embodiment of the present invention, the first powder is applied to bare surface 18 of aluminum article 12 to form first layer 14 as described above and illustrated in FIG. 1. In another exemplary embodiment, a conversion coating is applied to surface 18 of aluminum article 12 before the first powder is applied. Conversion coatings typically offer adhesion promoting and/or corrosion inhibiting characteristics to surface 18.

Figure 2:
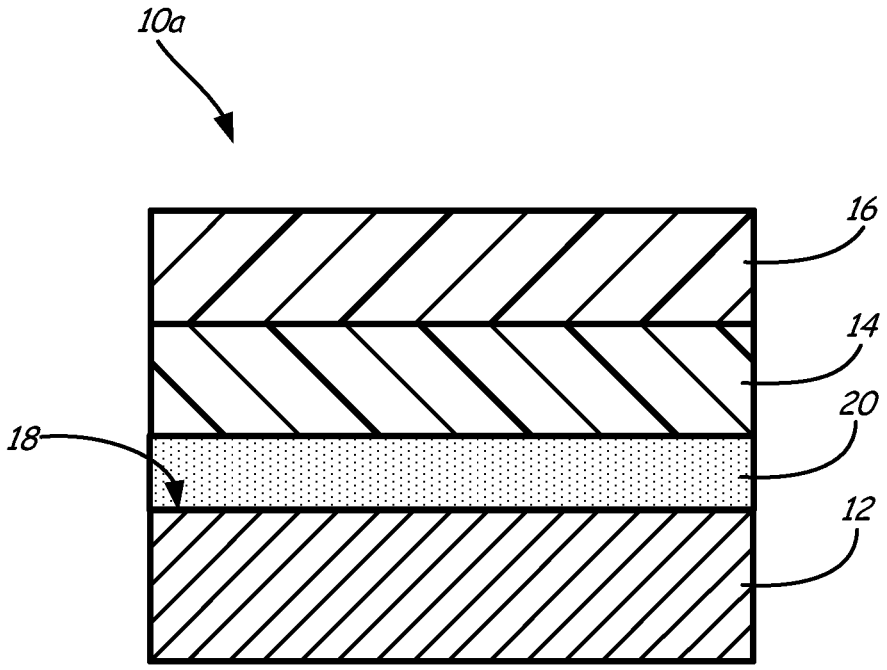
FIG. 2 is a side sectional view of a powder coating system for use on an aluminum article having a conversion coating.

FIG. 2 illustrates a side sectional view of dual powder coating system 10*a* and aluminum article 12 with conversion coating 20. Conversion coating 20 is applied to surface 18 before the first powder is applied and before first layer 14 is formed. Conversion coating 20 can be applied by spraying, dipping, fluidized bed spraying, electrostatic deposition, electrostatic magnetic brush coating or any other suitable coating method. Examples of suitable conversion coatings include chromate and phosphate conversion coatings, coatings containing trivalent chromium, zinc phosphate, iron phosphate, or manganese phosphate and combinations thereof.

Dual powder coating system 10*a* includes first layer 14 and second layer 16 as described above. First layer 14 is formed on aluminum article 12 over conversion coating 20 using a first powder. First layer 14 improves the mechanical strength, corrosion durability and bonding capabilities of aluminum article 12. Second layer 16 is formed over first layer 14 on aluminum article 12 using a second powder. Second layer 16 improves the UV resistance of aluminum article 12.

Figure 3:
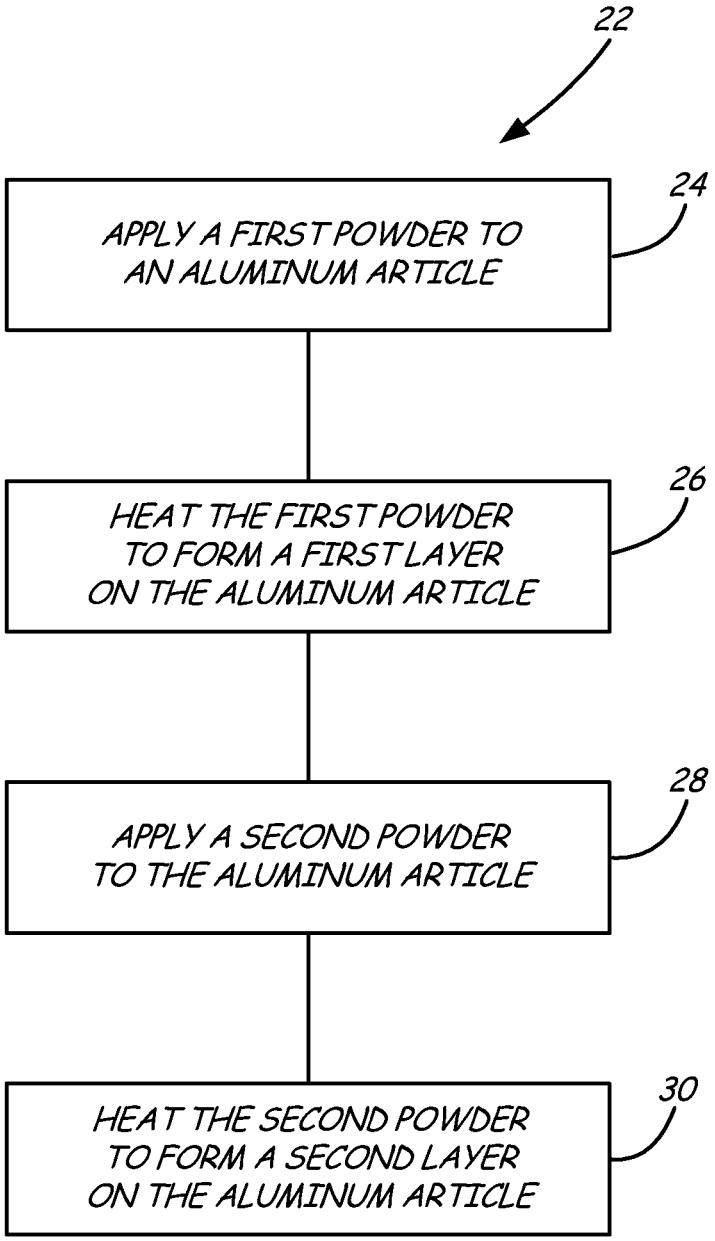
FIG. 3 is a flow chart illustrating a method for coating an aluminum article.

Dual powder coating systems 10 and 10*a* provide a method for coating an aluminum article. FIG. 3 is a flow chart illustrating a method of coating an aluminum article according to the present invention. Method 22 includes applying a first powder to an aluminum article (step 24), and heating the first powder to form a first layer on the aluminum article (step 26). The first layer provides increased mechanical strength, enhanced corrosion protection and improved bonding potential for the aluminum article. Method 22 also includes applying a second powder to the aluminum article (step 28), and heating the second powder to form a second layer on the aluminum article (step 30). The second layer protects the aluminum article from ultraviolet radiation. Application of each powder to the aluminum article and heating the powder can occur successively or contemporaneously. According to method 22, the first powder is heated before the second powder is applied to the aluminum article. According to method 22, the first powder can be applied directly to surface 18 of aluminum article 12 or to an aluminum article 12 having a conversion coating 20.

Figure 4:
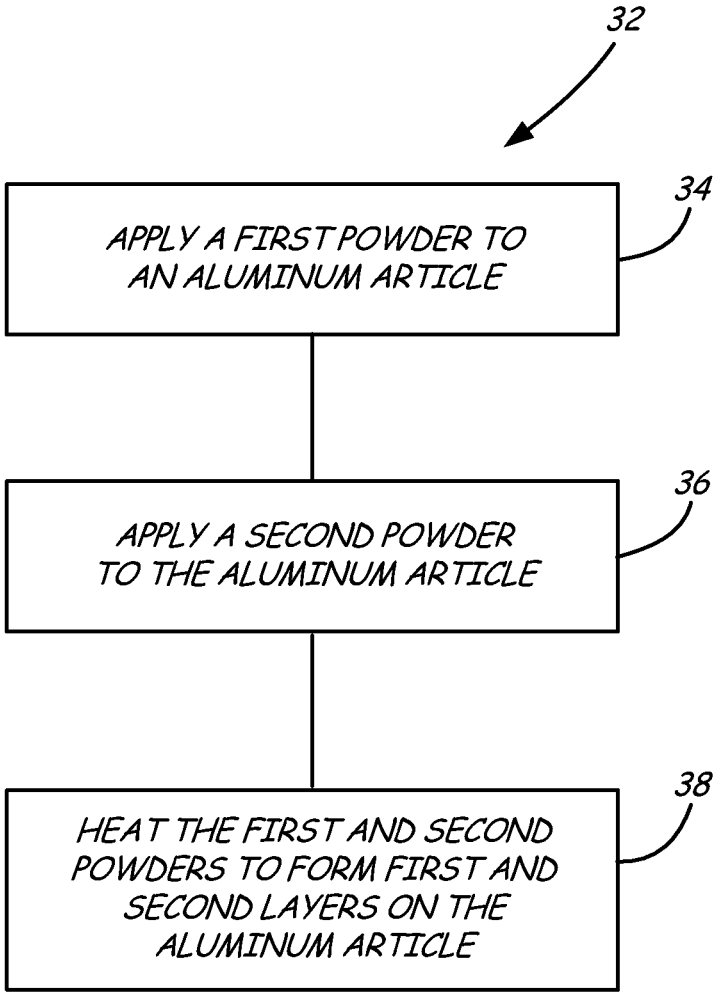
FIG. 4 is a flow chart illustrating another method for coating an aluminum article.

FIG. 4 is a flow chart illustrating another method of coating an aluminum article. Method 32 includes applying a first powder to an aluminum article (step 34), applying a second powder to the aluminum article (step 36) and heating the first and second powders to form first and second layers on the aluminum article (step 38). According to method 32, the second powder is applied to the aluminum article before the first powder is heated to form the first layer. The first and second layers are formed contemporaneously. According to method 32, the first powder can be applied directly to surface 18 of aluminum article 12 or to an aluminum article 12 having a conversion coating 20.

The dual powder coating system and method of the present invention provide an aluminum article with enhanced mechanical strength, improved bonding capability, enhanced corrosion durability and improved resistance to UV radiation. Aluminum articles can possess improved features in all of these areas rather than having to pick and choose from among them.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A method of coating a heat exchanger having an aluminum substrate, the method comprising:

applying a first epoxy-based powder to the aluminum substrate;

heating the first powder to melt and cure compounds of the first powder to form a first layer on the aluminum substrate having a thickness between about 15 microns and about 35 microns and providing mechanical strength, corrosion durability and bonding potential for the aluminum substrate;

applying a second powder over the first layer; and heating the second powder to melt and cure compounds of the second powder to form a second layer over the first layer, the second layer having a thickness between about 15 microns and about 35 microns and protecting the aluminum substrate from ultraviolet radiation.

2. The method of claim 1, wherein application of the first powder to the aluminum substrate is selected from the group consisting of spraying, dipping, fluidized bed spraying, electrostatic deposition, electrostatic magnetic brush coating and combinations thereof.

3. The method of claim 1, further comprising:

grounding the aluminum substrate before applying the first powder to, wherein the first powder is electrostatically applied to the aluminum substrate.

4. The method of claim 1, wherein the first powder is heated to melt and cure compounds of the first powder before the second powder is applied to the aluminum substrate.

5. The method of claim 1, wherein the first powder and the second powder are heated simultaneously.

6. The method of claim 1, wherein the first powder is selected from the group consisting of epoxies, polyester epoxies, acrylic epoxies, fusion-bond epoxy powder coatings and combinations thereof.

7. The method of claim 1, wherein the second powder is a thermoset powder coating.

8. The method of claim 1, wherein a component of the second powder is selected from the group consisting of an acrylic, a polyester, a urethane and combinations thereof.

9. The method of claim 8, wherein the second powder is selected from the group consisting of acrylics, polyester-based thermoplastic polyurethanes, polyester triglycidyl isocyanurate and combinations thereof.

10. The method of claim 1, and further comprising:

contacting the aluminum substrate with brazing flux and brazing the aluminum substrate, and removing residual flux from the aluminum substrate before applying the first powder.

11. The method of claim 1, wherein heating the first and second powders is selected from the group consisting of induction heating, oven heating, infra-red heating and combinations thereof.

12. The method of claim 1, wherein the first and second powders are heated to a temperature between about 190° C. and about 200° C. for between about 10 minutes and about 15 minutes.

13. The method of claim 1, further comprising:

applying a conversion coating to the aluminum substrate before applying the first powder.

* * * * *